US005429172A

United States Patent [19]

Hand

[11] Patent Number: 5,429,172

[45] Date of Patent: Jul. 4, 1995

[54] LOST FOAM PROCESS FOR CASTING LOW CARBON STAINLESS STEEL

[75] Inventor: Bryan Hand, Norton, Ohio

[73] Assignee: The Babcock & Wilcox Company, New Orleans, La.

[21] Appl. No.: 207,811

[22] Filed: Mar. 7, 1994

Related U.S. Application Data

[63] Continuation of Ser. No. 976,755, Nov. 16, 1992, abandoned.

[51] Int. Cl.[6] ..... B22C 7/02; B22C 9/04

[52] U.S. Cl. ..... 164/34; 164/61; 164/65

[58] Field of Search ..... 164/34, 35, 36, 65, 164/61, 7.1, 7.2

[56] References Cited

U.S. PATENT DOCUMENTS

| | | | |
|---|---|---|---|
| 3,741,281 | 6/1973 | Hauser-Lienhard | 164/61 X |
| 3,842,899 | 10/1974 | Hauser-Lienhard | 164/253 |
| 4,291,739 | 9/1981 | Baur | 164/34 X |
| 4,318,437 | 3/1982 | Kemp | 164/34 X |
| 4,612,968 | 9/1986 | Ashton et al. | 164/34 |
| 4,787,434 | 11/1988 | Cleary et al. | 164/34 |
| 4,828,006 | 5/1989 | Vander Jagt | 164/34 |

FOREIGN PATENT DOCUMENTS

| | | | |
|---|---|---|---|
| 0115402 | 8/1984 | European Pat. Off. . | |
| 51-105918 | 9/1976 | Japan | 164/7.1 |
| 52-30220 | 3/1977 | Japan . | |
| 55-114438 | 9/1980 | Japan . | |
| 58-167052 | 10/1983 | Japan | 164/61 |
| 59-191543 | 10/1984 | Japan | 164/61 |
| 61-276742 | 12/1986 | Japan | 164/7.2 |
| 64-40167 | 2/1989 | Japan | 164/34 |
| 3-128145 | 5/1991 | Japan | 164/61 |
| 4-251659 | 9/1992 | Japan . | |
| 1177033 | 9/1985 | U.S.S.R. | 164/65 |

OTHER PUBLICATIONS

Foundry Trade Journal, vol. 159, No. 3312, Sep. 1985, Clegg, "Expanded-Polystyrene Moulding—a Status Report", pp. 177–180, 183, 184, 187.

Abstract of Japanese Patent Publication 63-281757 published Nov. 18, 1988.

Abstract of U.S.S.R. Inventor's Certificate 1,616,758 published Dec. 30, 1990.

*Primary Examiner*—J. Reed Batten, Jr.

*Attorney, Agent, or Firm*—Daniel S. Kalka; Robert J. Edwards

[57] ABSTRACT

Low carbon stainless steel parts are formed utilizing a high vacuum of 20" to 29" of mercury during the pouring stage of the lost foam process.

13 Claims, 2 Drawing Sheets

LOST FOAM PROCESS FOR CASTING LOW CARBON STAINLESS STEEL

This is a continuation of application Ser. No. 07/976,755 filed Nov. 16, 1992 and now abandoned.

BACKGROUND OF THE INVENTION

1. Field of the Invention

The present application deals with lost foam casting processes in general and more particularly to a lost foam process for casting low carbon stainless steel.

2. Description of the Prior Art

Casting processes using lost foam are known and a description of such a process may be found in U.S. Pat. No. 2,830,343 granted to H. F. Shroyer. This casting process utilizes a cavityless casting method wherein a polystyrene foam pattern is embedded in sand. The foam pattern left in the sand is decomposed by molten metal that is poured into the foam pattern. The molten metal replaces the foam pattern thereby precisely duplicating all of the features of the pattern. Similar to investment casting using lost wax, the pattern is destroyed during the pouring process and a new pattern must be produced for every casting made.

The above described process thus utilizes the following basic steps. First a foam pattern and gating system is made using some sort of mold. Secondly, the mold or foam pattern and gating system are usually assembled into a cluster of individual parts to facilitate large volume production. The cluster is then coated with a permeable refractory coating. The prepared cluster is then placed into loose unbonded sand that is packed around the foam cluster by vibrating the entire mold assembly. The molten metal is then poured directly into the foam cluster decomposing the foam in the cluster and replacing it with the poured metal. The cluster is then removed, separated and the individual parts finished off in well known methods.

The previously described lost foam process has been used to produce gray iron and non-ferrous material parts. To-date, stainless steel has been impractical to pour utilizing the above procedure. The stainless steel molten metal generates carbon when it is volatilized and the carbon is absorbed into the liquid metal thereby raising the carbon level of the finished stainless steel product. Certain applications for stainless steel have ASTM Standards for carbon content that are within the ranges of 0.06% to 0.08% carbon. One such application for such stainless steel parts that have to be made according to this ASTM Standard is the tube hangers for nuclear reactors which require the parts to be produced from ASTM grade material A297HH.

Attempts were made to manufacture these mentioned tube hangers from stainless steel according to the above described lost foam process with unsatisfactory results. The sand surrounding the foam forms was even subjected to vacuums between 4" and 12" of mercury applied to the flask holding the sand and the parts to maintain the sand around the part. Even with these mentioned vacuum ranges, which are suggested in the prior art to maintain process integrity, the results were unsatisfactory.

Thus, it is seen that a lost foam process for manufacturing stainless steel parts which require a low carbon level according to application standards, such as those set by ASTM, was a requirement that was not met by the prior art.

SUMMARY OF THE INVENTION

The applicant's process solves the problems associated with the prior art lost foam production methods as well as others by providing a lost foam process that is able to manufacture stainless steel parts with minimal or very low carbon content.

To accomplish this, the applicant's process utilizes a high vacuum applied to the lost foam process during the pouring of the stainless steel. The pouring is done at a predetermined volume and temperature to allow the carbon generated during this molding process to be vacuum extracted resulting in low carbon stainless steel parts.

Thus it will be seen that one aspect of the present invention is to provide a lost foam process for manufacturing low carbon stainless steel parts.

Another aspect of the present invention is to provide a high vacuum lost foam casting process which will draw off any undesired volatile elements formed during the pouring process.

These and other aspects of the present invention will be more fully understood from a careful review of the drawings when considered in conjunction with the description of the preferred embodiment.

IN THE DRAWINGS

FIG. 1 is a perspective view of the lost foam apparatus utilized in the present process; and FIG. 2 is a schematic end view showing the apparatus of the present method.

DESCRIPTION OF THE PREFERRED EMBODIMENT

Figure 1:
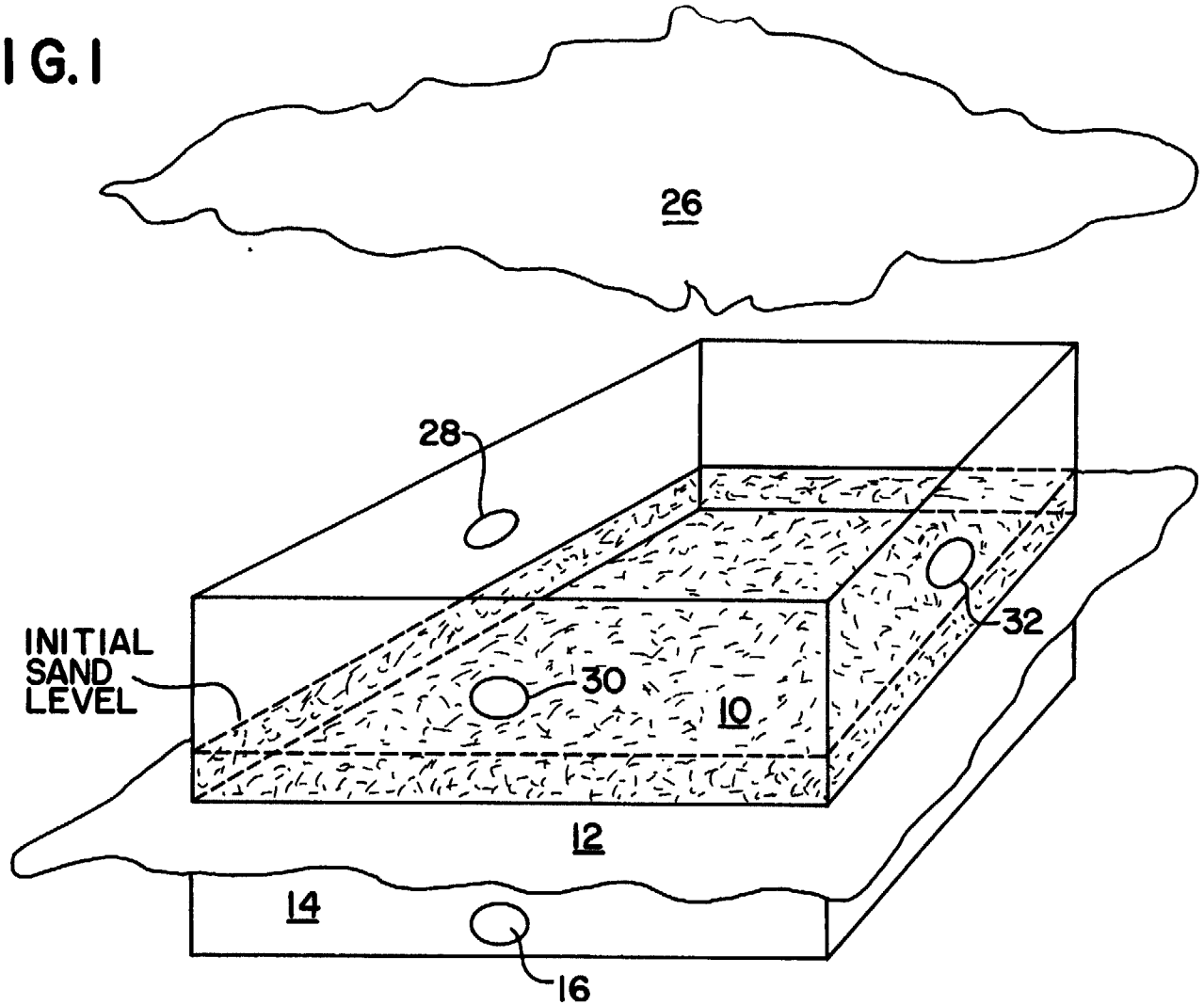
Figure 2:
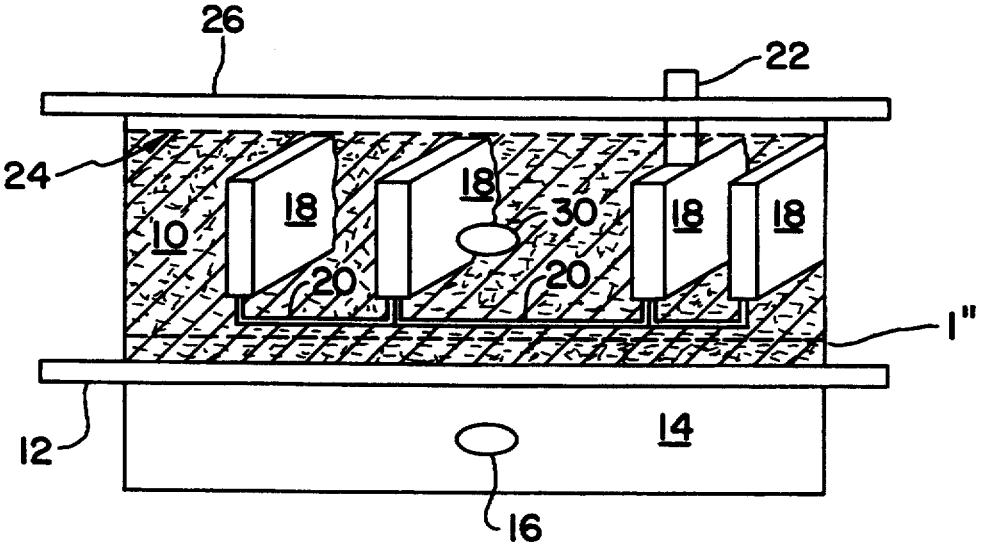

Referring now to the figures, it will be seen that a unique method of manufacturing stainless steel low carbon parts is disclosed utilizing known lost foam types of apparatus.

In the present method high alloy stainless steel boiler tube hangers are manufactured according to ASTM Standard A-297HH. The tube hangers are first made from plastic foam shaped material. The tube hangers are made from Poly Methyl Methylacrylate (PMMA) available from Dow Chemical Company. These boiler tube hangers are assembled into castable quantity assemblies consisting of 84 boiler tube hangers spacedly formed from a connecting element. These boiler tube hanger assemblies are then spray coated with a refractory coat of alumino-silicate approximately 4 mils in thickness. The coated assemblies are then allowed to dry for approximately 12 hours at a temperature of 120° F. after which time the tube hanger assemblies are ready to be utilized in the vacuum foam process apparatus.

The apparatus as seen in the figures is a standard lost foam type of apparatus wherein a open container (10) has a bottom layer (12) consisting of a 5 mil thick EVA film of Ethylene Vinyl Acetate. A bottom chamber (14) located below the main chamber (10) and separated by the film (12) subjects the film (12) to a vacuum of approximately 18" of mercury obtained by drawing the vacuum through an aperture (16). The open container (10) is approximately 15–20 feet square and is approximately 4–7 feet high.

The open container (10) is next filled with approximately a one inch layer of sand. Typically, two different types of sands may be used. One is sand that has a nominal American Foundry Society (AFS) grain fineness number of 90–100 with a dry permeability of approximately 65. Another type of sand is sand that has an AFS number of 34–38 and a dry permeability of a 450–525. Different types of washes for these sands were evaluated with a proven wash developed for use in automotive engine plants for producing gray iron engine components using known lost foam processes were chosen. Next, the four sets of boiler tube hangers (18) each consisting of 84 boiler tube hangers were placed into the open container (10) with each of the sets (18) being connected together by known gating methods (20) and a pour opening (22) for pouring the liquid stainless steel into the gated tube hanger assemblies (18). The open container (10) was filled with loose dry sand of the type previously discussed; since the molds are relatively delicate a controlled sand filling from a controlled hopper (not shown) is done to prevent undue mold destruction and/or individual tube hanger breakage. The open container (10) is then filled with sand to a level (24) which will cover the tube hanger assemblies (18). The filled top container is then vibrated to densify the entire sand bed. Of course, the previous steps were all done with the application of a vacuum of approximately 18" of mercury applied to the lower chamber (14) separated from the upper chamber (10) by the film (12).

Next the open container (10) is covered with a top film (26) of the same 5 mil thickness EVA material and a vacuum of approximately 22" inches of mercury is applied to the chamber (10) through three 2" vacuum hose lines connected to openings (28, 30, 32). These three vacuum lines draw approximately 500 CFM and during a pour will draw approximately 1500 CFM at a working vacuum range of approximately 20" to 29" mercury.

The molten stainless steel is then poured into the mold assemblies (18) by way of the inlet (22) extending through the film (26) to the assemblies (18). The molten stainless steel is poured at a temperature of approximately 2,450° F. The range of pour temperatures was determined to be approximately 2450° F. to 2900° F.

An analysis of the required pour temperatures was conducted and using the standard alloy depressant factors on solidus/liquidus of multi-alloy steels, an average liquidus was calculated to be 2,650° F.–2,675° F. On this basis, the desired pour temperature was selected at 2,875° F. plus or minus 25° F.

The mold pouring was timed with an average pour time of 18 to 22 seconds for the large four assembly tube hanger patterns being placed in the chamber (10) and an average pour time of 12 to 18 seconds for smaller numbers of tube hanger patterns/molds. This calculated out to a metal delivery rate of approximately 78–64 pounds per second and 75–50 pounds per second respectively.

An effort was made to reduce pour times by raising the temperature of the poured molten stainless steel to 2900° F. plus or minus 25° F. The increased temperature showed a corresponding decrease in the pour times and a lower incidence of misruns. A large pour which consisted of approximately 1400 pounds of molten stainless steel took an average pour time of 10 to 14 second as opposed to the 18 to 22 second pour time at the lower molten metal temperature. The average pour rate was thus increased from the 78–64 pound per second range to a range of 140–100 pounds per second at the elevated molten metal temperature. As was discussed earlier, all of these pours were done at a vacuum of approximately 20–29 inches of mercury applied to the chamber (10) with no vacuum being applied to the lower chamber (14) during the pouring process. It is hypothesized that the high vacuum applied to the chamber (10) during the pouring of the stainless steel not only helps the pour of the molten metal by drawing the molten metal into the mold assemblies (18) but also allows the evacuation of the carbon fumes from the chamber (10) during the pouring process. It was noted during one of the tests that whereas approximately 1400 pounds of metal was poured into the mold assemblies (18) within a time period of ten seconds under the application of the high vacuum the same amount of molten metal required approximately 25–30 seconds to be poured into the molds (18) without the application of any vacuum.

The castings produced from the high vacuum lost foam process were analyzed and showed minimal to no carbon pickup. Differential metallography from the surface showed a worst case of 0.03% carbon pickup and a best case of slight decarburization. By way of contrast, samples made from regular lost foam processes without the use of high vacuum during the pour showed significantly higher levels of carbon pickup with a worst case of 0.23% and a best case of 0.09%. As was discussed earlier, carbon pickup is critical in stainless steel applications such as boiler hangers since high levels of carbon affect subsequent attachment welds for these hangers and the hangers must be produced according to ASTM's Standards which require a low carbon content for the stainless steel.

It will be understood that certain modifications and improvements were not disclosed herein for the sake of conciseness and readability but that all such modifications and improvements are considered to be within the scope of the following claims.

I claim:

1. A process for casting low carbon stainless steel parts utilizing the lost foam process, comprising the steps of:

forming a sand filled chamber having a foam form of parts to be cast contained therein;

covering a top of said sand filled chamber to seal the foam form in the chamber thereby;

applying a vacuum to the sealed chamber in the range of approximately 20" to 29" of mercury to provide a vacuum in the chamber and to the foam form of the parts to be cast therein; and pouring molten stainless steel in a temperature range of 2450° F. to 2900° F.±25° F. into the foam form to replace the foam form with molten stainless steel; and vacuum extracting any generated carbon to produce low carbon cast stainless steel parts.

2. A process as set forth in claim 1, wherein the molten stainless steel is poured at a temperature of 2,900° ±25° F.

3. A process as set forth in claim 2, wherein the vacuum is drawn from three sides of the chamber at a volume of 500 CFM.

4. The process as set forth in claim 2, wherein the chamber is covered with a plastic film of Ethylene Vinyl Acetate material approximately 5 mils thick.

5. The process as set forth in claim 1, wherein the foam form of the parts is manufactured from poly methylacrylate.

6. The process as set forth in claim 5, wherein the foam form of the parts is coated with alumino-silicate.

7. The process as set forth in claim 6, wherein the coated foam parts are dried for a period of approximately 12 hours at a temperature of approximately 120° F.

8. The process as set forth in claim 7, wherein the foam parts are made as an assembly of a plurality of boiler tube hangers.

9. The process as set forth in claim 1, wherein the sand filled chamber is formed with a bottom plastic film floor to which a vacuum of approximately 18" of mercury is applied.

10. The process as set forth in claim 9, wherein the vacuum applied to the floor film is relieved when the chamber vacuum is applied.

11. The process as set forth in claim 1, wherein the sand filled chamber is filled with sand having a grain fineness of 34–38 and a dry permeability of 450–525.

12. The process as set forth in claim 9, wherein the sand filled chamber is filled with sand having a grain fineness of 90–100 and a dry permeability of approximately 65.

13. A process for casting a low carbon metal part, comprising the steps of:

forming a sand filled chamber having a foam form of a part to be cast contained therein;

covering said sand filled chamber to seal the foam form in the chamber thereby;

applying a vacuum to the chamber in the range of approximately 20" to 29" of mercury to provide a vacuum to the chamber and the foam form therein;

pouring molten low carbon metal in a temperature range of 2450° F. to 2900° F.±25° F. into the foam form to replace the foam form with the molten metal; and vacuum extracting any generated carbon to produce a low carbon cast metal part.

* * * * *